United States Patent [19]

Shoemaker

[11] 4,319,386

[45] Mar. 16, 1982

[54] BUCKLE WITH RIGID PLATE AND SLEEVE

[76] Inventor: Roger D. Shoemaker, 2861 Lakeshore Dr., Manistee, Mich. 49660

[21] Appl. No.: 55,985

[22] Filed: Jul. 9, 1979

[51] Int. Cl.[3] ..... A44B 11/00

[52] U.S. Cl. ..... 24/164; 24/181; 24/176; 24/194; 24/211 L

[58] Field of Search ..... 24/181, 164, 175, 176, 24/180, 182, 194, 206 R, 211 L

[56] References Cited

U.S. PATENT DOCUMENTS

| | | | |
|---|---|---|---|
| 133,904 | 12/1872 | Walker | 24/164 R |
| 374,764 | 12/1887 | Very | 24/176 |
| 636,334 | 11/1899 | Hammer | 24/164 |
| 1,490,941 | 4/1924 | Sachs | 24/182 |
| 2,342,210 | 2/1944 | Murphey | 2/322 |
| 2,481,788 | 9/1949 | Sherwood | 24/182 |
| 2,634,480 | 4/1953 | Ray | 24/180 |
| 2,641,812 | 6/1953 | Boudreau | 24/176 |
| 3,088,184 | 5/1963 | Pittner | 24/175 |
| 3,208,124 | 9/1965 | Rossi | 24/181 |
| 3,209,423 | 10/1965 | Cattin | 24/181 |

*Primary Examiner*—Victor N. Sakran

*Attorney, Agent, or Firm*—Price, Heneveld, Huizenga & Cooper

[57] ABSTRACT

This invention relates to buckles and more particularly to a strap buckle for either forming a loop in a flexible strap or for securing one strap to another. It is particularly useful for securing and adjusting the cheek strap or connecting the throat strap of a bridle. The invention provides a rigid plate which is permanently secured to a strap. The plate has a stud designed to pass through an opening in the strap to be connected. The plate is also provided with a pair of sleeves through which both straps pass when they are superimposed over each other and connected. One of the sleeves is slidable along the plate and in one position is centered over the stud. The sleeves are rigid to eliminate flexing under loads which tend to pull the straps apart and thus prevent the straps being separated at the stud.

14 Claims, 8 Drawing Figures

BUCKLE WITH RIGID PLATE AND SLEEVE

BACKGROUND OF THE INVENTION

Buckles are old and well-known means of making connections where straps are involved. Despite the long history of buckles and their extensive development, the flat-type buckle has not been satisfactory because of its tendency to open under certain types of circumstances. These buckles have been so made that they are capable of flexing. This permits the strap and the stud which provides the physical connection to separate when the pull applied to the connection acts in a direction tending to pull the straps apart. Thus, buckles of this type have not been as dependable as they should be. This is important particularly in the case of bridles because the failure of a buckle in a bridle can result in the rider losing control of the horse. This can lead to a runaway situation and possibly to serious injury.

BRIEF DESCRIPTION OF THE INVENTION

The invention provides a rigid, elongated plate which serves as a base for the buckle. One end of the plate is rigidly secured to the strap. The plate has a projecting stud which engages through a hole either in the strap to which the plate is attached, if a loop is to be formed, or in a second strap if the buckle is to be used to connect a pair of separate straps. A pair of rigid ring-like members are provided, each of which has one side seated in the channel formed between the folded back portions of the plate. One of the members is an elongated sleeve slidable along the plate so that it may be moved into a position where it is centered over the stud and entraps a strap impaled on the stud so as to prevent separation of the impaled strap and stud. Preferably, the one end of the plate opposite the end to which the strap is secured is folded back upon the remainder of the plate to form a narrow, blind channel in which the movable, elongated sleeve is slidable. This folded over end is shaped to resiliently hold the movable sleeve in place. The rigid plate in cooperation with the rigid members prevent bending of the connected straps preventing the sleeve or ring which entraps the impaled strap on the stud from shifting. This results in a buckle which will not permit strap separation without the positive intervention of an operator to intentionally displace the slidable member.

DESCRIPTION OF THE PREFERRED EMBODIMENT AND MODIFICATIONS

Figure 2:
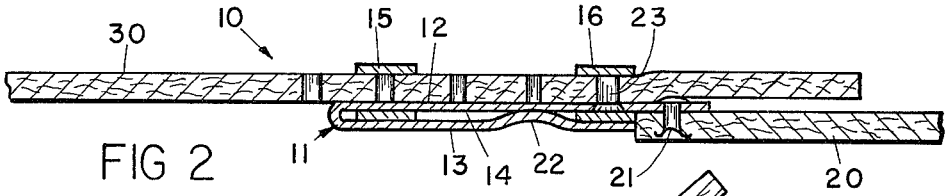
FIG. 2 is a sectional view taken along the plane II—II of FIGS. 1.

The numeral 10 refers to a buckle having a plate 11 formed from a narrow, elongated strip of metal which is bent back upon itself to form a base leg or portion 12 and a return leg or portion 13, defining a narrow, slit-like, blind channel 14 between them. The plate 11 is made from heavy gauge metal such that it is rigid and will not bend or flex under normal operating conditions for the buckle.

The buckle is provided with a pair of ring members or sleeves. One of these is the fixed sleeve 15 and the other is the movable sleeve 16. Both sleeves are tubular bands of rectangular configuration having one side seated in and extending laterally through the channel 14. The shape and size of the internal opening or passage through the sleeves is such that a strap together with one leg of the plate may pass through it with a close, sliding fit. The fixed sleeve 15 is seated near the blind end of the channel 14 and may be secured there by any means such as pinching the sides of the channel together to frictionally hold it in position. However, it need not be so secured and may simply be left at the blind end of the channel. Thus, it is fixed in the sense that it is not shifted lengthwise of the channel during opening and closing of the buckle. On the other hand, the movable sleeve 16 is designed to slide lengthwise of the channel.

One end of a strap 20 is secured to the free end of the base leg 12 of the plate by a rivet 21. The preferred construction is a plate 11 having the same width as the strap. Thus, a wide strap uses a wide plate and a narrow strap a narrow plate. The width of the plate should not be significantly less than that of the strap because this will significantly reduce the lateral stability of the sleeves. The importance of this will be explained subsequently.

The return leg 13 of the plate is shorter than the base leg 12 and its end abuts the end of the strap 20. Thus the end of the strap 20 blocks the open end of the channel 14. Spaced from the end of the strap 20 toward the blind end of the channel approximately the length of the movable sleeve 16 is a detent 22 formed by offsetting the return leg so as to close or partially close the channel 14. Between the detent 22 and the end of the return leg 13, a stud 23 is rigidly secured to the base leg and projects from the base leg away from the return leg. The length of the stud 23 is such that the movable sleeve 16 may pass over it as shown in FIG. 2. It will be seen that the end of the strap 20 and the detent 22 trap the movable sleeve 16 between them, preventing it from moving from a position where it is centered over the stud 23 unless an operator specifically forces the movable sleeve past the detent 22 into the space between the detent and the fixed sleeve 15.

The strap 30 to be secured to the strap 20 by means of the buckle is provided with one or more holes 31 of a size to closely fit about the stud 23. To attach the strap 30 to the strap 20, the movable slide 16 is shifted to a position close to the fixed slide 15. The strap 30 is then inserted through the sleeves 15 and 16 and one of the holes 31 aligned with the stud 23. The strap is then seated down over the stud so that the stud impales the strap. The movable slide 16 is forcibly moved past the detent to seat over the stud thus trapping the strap 30 between the slide and the base leg of the plate. The stud provides a positive connection between the plate 11 and the strap 30 and thus between the two straps. Since the sleeve 16 is trapped between the end of the strap 20 and the detent 22, the strap is positively prevented from working its way off or otherwise becoming detached from the stud 23.

To enable the sleeve to effectively perform this function it must be rigid, that is, it must not flex or stretch to permit the strap 30 to work its way off the stud 23. The sleeve must also be long enough that it holds the strap 30 firmly against the plate 11 not only immediately at the stud but for a sufficient distance on each side of the stud that the strap cannot work its way partially up the stud and thereby gradually enlarge the hole 31 until the stud is no longer effective. The sleeve must also fit sufficiently closely about the encircled leg of the plate and the strap passing through it, that the sleeve cannot rock lengthwise, crosswise or lengthwise of the strap or pivot about its center. Any of these movements may severely reduce the sleeve's ability to hold the strap impaled on the stud.

Figure 3:
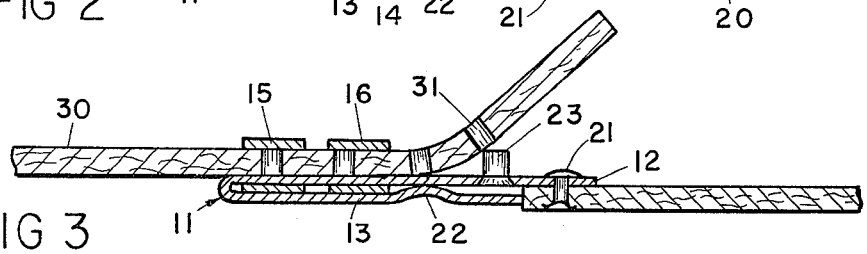
FIG. 3 is a sectional view similar to FIG. 2 illustrating the buckle in the process of being opened.
Figure 1:
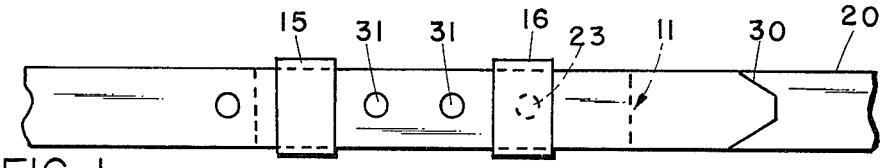
FIG. 1 is a fragmentary view of a pair of straps connected by means of this invention.
Figure 4:
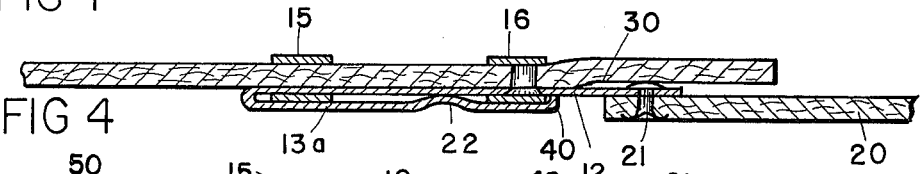
FIG. 4 is a sectional view similar to FIG. 2 illustrating a modified construction for the invention.

FIG. 4 illustrates a modification very similar to the structure illustrated in FIGS. 1, 2 and 3 and identical parts have like numbers. In the case of the modification illustrated in FIG. 4, the return leg 13*a* is modified to the extent that, at its free end, it is provided with a lip 40 extending toward the base leg 12 and closing the open end of the channel 14. The lip 40 provides a stop for the sliding sleeve 16 to prevent it from moving out of the otherwise open end of the blind channel 14. The provision of the lip 40 is necessary where the end of the strap 20, for one reason or another, is not positioned at the end of the return leg and thus does not function as a stop closing the end of the channel. It will be recognized that the function of the modified structure illustrated in FIG. 4 is the same as the structure illustrated in FIGS. 1–3.

Figure 6:
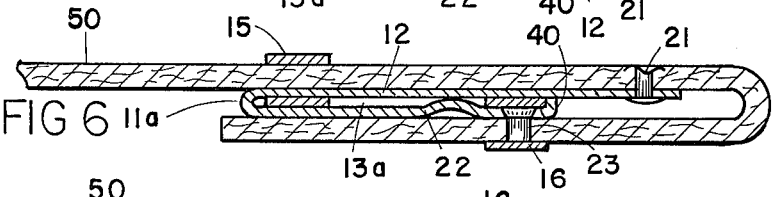
FIG. 6 is a sectional view taken along the plane VI—VI of FIG. 5.
Figure 5:
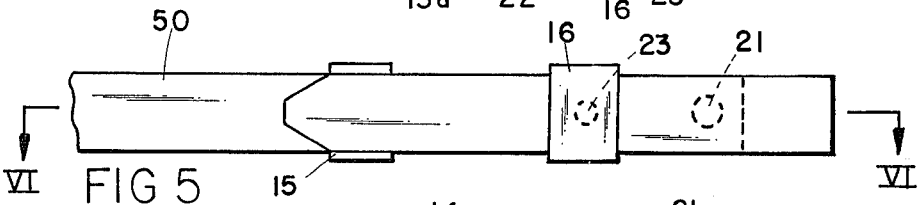
FIG. 5 is a fragmentary view of the invention applied to the formation of a loop in the end of a strap.

FIGS. 5 and 6 illustrate the application of this invention to the formation of a loop at the end of a strap. In this construction the plate 11*a* has a base leg 12 and a return leg 13*a* and to this extent the plate is identical to the plate illustrated in FIG. 4. The return leg 13*a* also has the lip 40 serving as a stop at the end of the channel. The buckle also has a pair of sleeves including the fixed sleeve 15 and the movable sleeve 16. However, in this case, the movable sleeve 16 extends oppositely from the fixed sleeve 15 and thus the return leg 13*a* rather than the base leg 12 passes through the movable sleeve 16. The stud 23, instead of being secured to the base leg 12, is secured to the return leg 13*a* adjacent the lip 40. As in the case of the plate 11, a detent 22 is provided to form a pocket between it and the lip 40 to trap the movable sleeve 16. A strap 50 is passed through the fixed sleeve 15 between the outer side of the sleeve and the base leg 12 of the plate and extends beyond the end of the plate and is looped back to pass over the stud 23 where it is provided with an opening so that it may be impaled on the stud 23. Near the free end of the base leg 12, the strap is permanently secured to the plate 11*a* by a rivet 21. To secure the strap in its looped configuration, the movable sleeve 16 is shifted to a position where it is centered about the stud and thus is trapped between the lip 40 and the detent 22, positively preventing the strap 50 from working its way off the stud 23.

Figure 7:
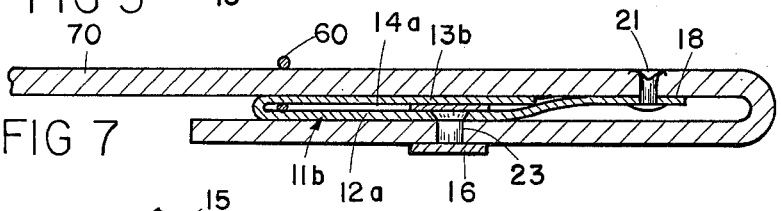
FIG. 7 is a sectional view similar to FIG. 6 illustrating a modification of the construction illustrated in FIG. 6.
Figure 8:
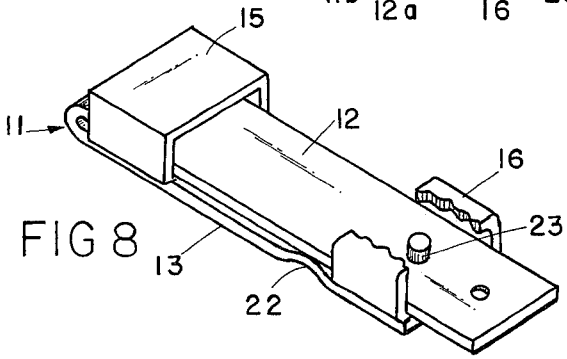
FIG. 8 is an oblique view, partially broken, of the buckle structure of FIG. 2.

FIG. 7 illustrates a modification of the plate illustrated in FIG. 6. In this construction the plate 11*b* has a base leg 12*a* and a return leg 13*b*. The return leg 13*b* is substantially shorter than the base leg 12*a*. Near the end of the return leg 13*b*, the base leg is offset toward the return leg 13*b* such that its free end 18 is in the same plane as the return leg 13*b*. By so doing, the offset in the base leg closes the end of the blind channel 14*a*. At the blind end of the channel 14*a*, a wire-like ring 60 is substituted for the sleeve 15. Like the sleeve, it is a closed loop and is of rectangular cross section. It functions in the same manner as the fixed sleeve 15 and the only purpose of substituting the wire-type ring 60 for the fixed sleeve 15 is to provide more room in the channel 14*a* than would be permitted by the use of the sleeve because the channel has been substantially shortened in length. In this case, the stud 23 is secured to the base leg 11*b* adjacent the offset and between the blind end of the channel and the offset. The stud extends outwardly from the base leg 11*b* oppositely from the return leg 13*b*. The sliding sleeve 60 has one side seated in the channel 14*a* and, when the buckle is closed, is centered over the stud 23.

A strap 70 is passed through the ring 60 and is secured to the plate at the free end 18 of the base plate 11*b* by a rivet 21. The strap 70 extends beyond the end of the plate and is looped back to pass over the stud 23 which impales it through a suitable opening and also through the movable sleeve 16. It will be seen from FIG. 7 that when the movable sleeve is positioned over the stud, the strap is entrapped within the movable sleeve 16 where, because of the length and fit of the sleeve, the strap cannot become disengaged from the stud. While FIG. 7 does not illustrate the use of a detent 22, such a detent could be provided to resist movement of the sleeve 16 from its position over the stud. However, because of the shortness of the blind channel 14*a* and the fact that the return leg is sandwiched between the base leg 12*a* and the strap 70, under many circumstances sufficient clamping pressure is exerted on the sides of the plate to provide enough frictional resistance to sliding movement to retain the sleeve 16 in locked position.

Preferably the plates 11, 11*a* and 11*b* are all metallic and fabricated from a material such as steel or cast from brass. It is important that the thickness of the plate be such that the plate exhibits a high degree of rigidity and will not flex or bend with the straps. It is also important that both the fixed and sliding sleeves 15 and 16 and the ring 60 be of a size such that there is a close sliding fit of the strap within the ring where it passes through the ring. It is important that the strap be closely held against the surface of the plate by these sleeves or rings. While it is possible to substitute a ring for the elongated sleeve in the case of the fixed sleeve, this is not possible in the case of the sliding sleeve for the reasons already explained. The invention can be used with most straps. However, the straps should have significant thickness such as 3/32 or ⅛ inch. It is particularly useful in connection with leather straps such as the leather harness straps used in bridles.

The invention provides a simple structure which may be easily and readily manipulated by the operator without the necessity of using excessive force. Thus, it is particularly useful in such situations as in bridling a horse where it is desirable to put on or take off the bridle quickly and with a minimum of complexity in opening or closing the buckle. The structure of the buckle permits it to be either unobtrusive or lends itself to ornamentation to make it attractive.

Having described the preferred embodiment of the invention and several modifications, it will be recognized that other modifications may be made incorporating the principles of the invention. Such of these modifications as do not depart from the principles of the invention are to be considered as included in the hereinafter appended claims unless these claims by their language expressly state otherwise.

The embodiments of the invention in which an exclusive property or privelege is claimed are as follows:

1. A buckle comprising: an elongated rigid plate, said plate having a base leg and a return leg, said return leg being the free end of said plate doubled back upon itself and closely paralleling said base leg to form a blind channel between said legs; a pair of rigid ring elements of rectangular cross section; one of said ring elements having one side seated in said channel adjacent said blind end, said other ring element having one side seated in said channel and being elongated to form a tubular sleeve of rectangular cross section; a stud projecting outwardly from one of said legs and being of a length substantially equal to the spacing from said plate to the other side of said other ring element; said other ring element being of a size to slidably receive and seat closely about a flexible strap extending therethrough and seated against said plate, said other ring element being slidable along said plate from adjacent said one ring element to a position substantially centered over said stud to trap a strap passing through said other ring element, means for securing said base portion of said plate to a strap, and a retaining closing means for closing the end of said channel and forming a stop limiting movement of said other ring element, said stop providing a seat for said other ring element when it is aligned with said stud.

2. A buckle as described in claim 1 wherein means are provided to frictionally resist sliding movement of said other ring element along said plate toward said blind end when said other element is substantially centered over said stud.

3. A buckle as described in claim 2 wherein said means is a detent extending into and partially closing said channel.

4. A buckle as described in claim 3 wherein said retaining closing means comprises the free end of said return leg having a lip closing the end of said channel and forming said stop limiting movement of said other ring element.

5. A buckle as described in claim 4 wherein said stud is mounted to said return leg adjacent said lip.

6. A buckle as described in claim 1 wherein a strap is provided attached to said end of said base leg by said securing means, said strap passing through said one ring element and being looped about the end of said base leg and having a free end passing through said other ring element; said stud and said other ring element extending from said plate oppositely from said one ring element; a hole in said strap receiving said stud therethrough; said other ring element being of a size to fit closely about said strap and plate leg passing therethrough.

7. A buckle as described in claim 1 wherein a strap is provided attached to said end of said base leg by said securing means; both of said ring elements extending away from said plate in the same direction; a second strap passing through both of said elements; a hole in said second strap receiving said stud therethrough.

8. A buckle as described in claim 7 wherein means are provided to frictionally resist sliding movement of said other ring element along said plate toward said blind end when said other element is substantially centered over said stud.

9. A buckle as described in claim 8 wherein said means is a detent extending into and partially closing said channel.

10. A buckle as described in claim 8 wherein said stud is mounted to said base leg adjacent said means securing said strap to said base leg.

11. A buckle as described in claim 10 wherein the end of said first strap is seated against the free end of said return leg for closing the open end of said channel and limiting movement of said other ring element through said channel end.

12. A buckle as described in claim 1 wherein said base leg extends beyond the end of said return leg and adjacent the end of said return leg is offset toward said return leg to form a stop closing the open end of said channel and limiting movement of said other ring element through said channel end.

13. A buckle for use with a flexible strap, said buckle comprising: a strap means and an elongated rigid metallic plate fixedly secured to the strap, said plate having a base leg and a return leg, said return leg being the free end of said plate doubled back upon itself and closely paralleling said base leg to form between said legs a channel with a blind end, rigid tubular sleeve means of rectangular cross section slidable on said plate and having portions extending into said blind channel between said legs; retaining means on said sleeve means and said legs and cooperating with said blind end of said channel for preventing said sleeve from sliding off from said base leg by forming a stop limiting movement of said sleeve means, a stud secured to one of the legs of said plate and spaced from said blind end and extending away from the other of the legs of said plate; said stud having a height substantially equal to the thickness of the strap; said strap means having a free end passing through said fixed and slidable sleeve means; said free end of said strap means having an opening therein to receive said stud; said sleeve means being slidable along said plate to a first position located about said stud to lock said free end of said strap means to said stud and being slidable along said plate to a second position permitting removal of said free end of said strap means from said stud, and wherein said stop provides a seat for said sleeve means when said sleeve means is located about said stud.

14. A buckle as described in claim 13 further including frictional resistance means for frictionally resisting sliding movement of said sleeve means along said plate in a direction toward said blind end when said sleeve means is located over said stud, and wherein said frictional resistance means is a detent extending into and partially closing said channel.

* * * * *